United States Patent [19]

Smith, Jr.

[11] 3,980,864

[45] Sept. 14, 1976

[54] AUTOMATIC MECHANICAL VOTING MACHINE WITH ELECTRONIC READOUT

[75] Inventor: Earl H. Smith, Jr., Levittown, Pa.

[73] Assignee: International Election Systems Corporation, Burlington, N.J.

[22] Filed: Aug. 18, 1975

[21] Appl. No.: 605,601

Related U.S. Application Data

[62] Division of Ser. No. 370,835, June 18, 1973, Pat. No. 3,904,854.

[52] U.S. Cl. ..... 235/54 F; 235/55 R

[51] Int. Cl.[2] ..... G07C 13/00

[58] Field of Search ..... 235/51, 54 F, 54 R, 235/54 A, 54 C, 54 E, 55 R, 55 A

[56] References Cited

UNITED STATES PATENTS

| | | | |
|---|---|---|---|
| 3,227,364 | 1/1966 | Clark | 235/54 F |
| 3,312,390 | 4/1967 | Shoup | 235/54 R |
| 3,595,472 | 1/1971 | Darling | 235/54 F |
| 3,710,105 | 1/1973 | Oxendine | 235/54 F |
| 3,739,151 | 6/1973 | Moldovan | 235/54 F |
| 3,787,662 | 1/1974 | Martin | 235/54 F |
| 3,793,505 | 2/1974 | McKay | 235/54 F |

*Primary Examiner*—L. T. Hix
*Assistant Examiner*—Vit W. Miska
*Attorney, Agent, or Firm*—Ostrolenk, Faber, Gerb & Soffen

[57] ABSTRACT

A switch is added to each spindle of a conventional mechanical voting machine where the spindle is rotated or otherwise actuated by a voter when casting a vote for a particular office. The switch is normally open and is closed by the movement of the spindle from a "no vote" position to a "vote" position. An electronic scanning device is connected to the switch of each spindle of the voting machine and electronically scans the condition of each switch of the voting machine when the vote is registered by the operation of the curtain handle by the voter. The electronically scanned output of each of the switches is then transmitted over telephone lines either instantaneously or after a given storage period which could last till the close of the polls, to centrally located computers at county, state, federal and news media locations. These computers keep a current running total of the vote in various categories and further provide print-out at the close of the polls.

9 Claims, 4 Drawing Figures

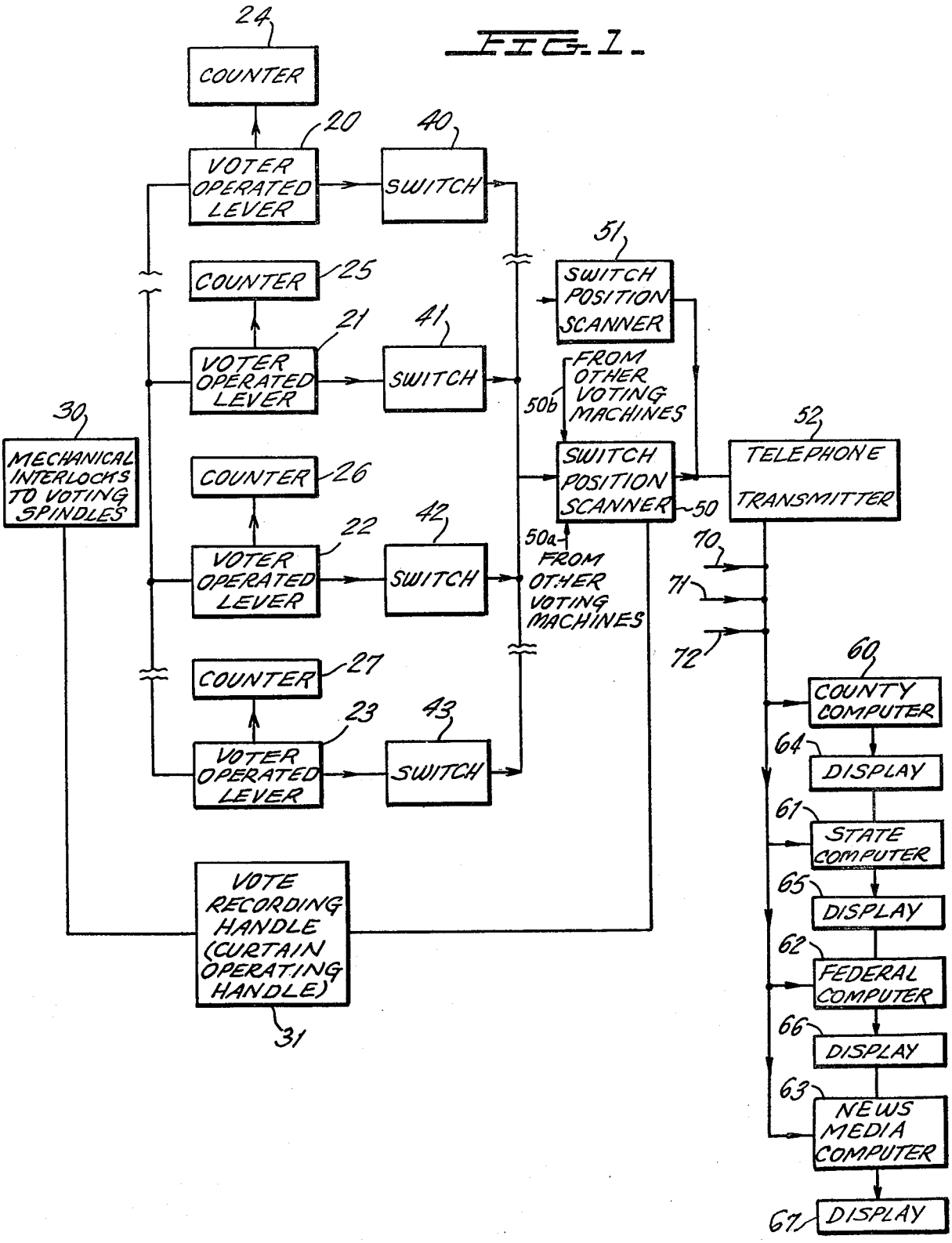
FIG. 1
COUNTER
24
VOTER OPERATED LEVER
20
SWITCH
40
COUNTER
25
VOTER OPERATED LEVER
21
SWITCH
41
COUNTER
26
VOTER OPERATED LEVER
22
SWITCH
42
COUNTER
27
VOTER OPERATED LEVER
23
SWITCH
43
MECHANICAL INTERLOCKS TO VOTING SPINDLES
30
VOTE RECORDING HANDLE (CURTAIN OPERATING HANDLE)
31
SWITCH POSITION SCANNER
51
FROM OTHER VOTING MACHINES
50b
SWITCH POSITION SCANNER
50
50a
FROM OTHER VOTING MACHINES
TELEPHONE TRANSMITTER
52
70
71
72
COUNTY COMPUTER
60
DISPLAY
64
STATE COMPUTER
61
DISPLAY
65
FEDERAL COMPUTER
62
DISPLAY
66
NEWS MEDIA COMPUTER
63
DISPLAY
67

AUTOMATIC MECHANICAL VOTING MACHINE WITH ELECTRONIC READOUT

This is a division of application Ser. No. 370,835, filed June 18, 1973, how U.S. Pat. No. 3,904,854.

BACKGROUND OF THE INVENTION

This invention relates to a novel electronic adapter for a conventional mechanical voting machine to allow electronic readout of the mechanically counted vote to conventional computer stations. Thus, the vote can be electronically monitored and analyzed while maintaining the mechanically indicated vote count and all desirable features of the mechanical voting machine.

There are many well-known systems which have been and are presently in use for the casting of votes of an electing body. One such device is the well-known automatic mechanical voting machine which contains an array of mechanically operated levers which each correspond to a given candidate or question and which are selectively operated by the voter in order to record his vote. All mechanical machines for a given election will have identical arrays of levers. The actuation of these levers is suitably interlocked, typically, so that only one vote can be cast for a particular office, and so that the voter can change his vote before recording his entire vote. Recording the vote is caused by actuating a curtain handle which opens a security curtain which normally screens the voter while he is in the voting booth. The vote is recorded in mechanical counters respectively associated with each of the spindles on the machine when the vote recording handle is operated.

Another type of voting system, which is less widely used than the mechanical machine, but which lends itself to electronic data processing techniques uses a data processing card which is punched at certain end positions by a voter to cast a ballot. The major advantage of this system over the mechanical voting machine is that the punched cards can be processed with conventional data processing equipment so that election results can be quickly obtained and tabulated following the closing of the poles.

A serious disadvantage of the card equipment is that there is no way to indicate to the voter that an improper vote has been cast, as by punching two votes for two different individuals for a single office. This could be done inadvertently and would invalidate the voter's ballot. A further disadvantage with the card system is that it is difficult to change a vote since a new card must be obtained by the voter and repunched in place of his original card. A final serious disadvantage of the card system is the lack in security in that a mechanical count is not available in the polls and the cards can be lost in transit to data processing equipment, whereby the entire vote of a locality can be lost or tampered with, with no recourse available to a source which could confirm the computer readout of the election results.

BRIEF SUMMARY OF THE INVENTION

In accordance with the present invention, the conventional mechanical voting machine which may be of the type shown, for example, in any of U.S. Pat. Nos. 2,826,365 and 3,312,390 is provided with electrical switch means on each spindle which may be normally open and are closed when the spindle is rotated to a "vote" position. Obviously, the switches can be arranged so that they are normally closed and then opened when a vote is cast. The rotatable spindles which carry the switches could be other mechanically or electrically voter-actuated elements such as push buttons and the like. The condition of the switches is then scanned by a suitable electronic scanning mechanism at the time the voter records his vote. Thus, the vote is conventionally recorded on mechanical counters at each spindle when the voter operates the conventional curtain handle of a voting machine. In accordance with the invention, this act of recording also causes the operation of the electronic scanner.

The scanned information may then be stored in the scanner for a short time, although, if desired, the information may be instantaneously transmitted toward a computer system.

Preferably, the scanner output, when accessed, is connected over telephone lines to a central computer region. The central computer region may be located in one or more county offices and other similar computer regions can be located in state and federal offices. Further computer terminals may be located at news media offices. Each of these computer regions may have respective tabulation equipment and displays for indicating a running total of the vote and may have a final readout and display of the vote for each office or question submitted to the electorate at the closing of the polls.

An important feature of the invention is that the mechanical count of the results at each mechanical voting machine is still available at the mechanical counter at each spindle of the machine so that, even though immediate readout of the results of an election are electronically available, this tabulation is subject to verification by conventionally tabulating the mechanical vote at each machine at relative leisure. Moreover, the present system retains all the interlock and safety advantages of the conventional mechanical voting machines but additionally permits the application of computer capability to the processing of the vote as it progresses.

BRIEF DESCRIPTION OF THE DRAWINGS

FIG. 1 is a block diagram which schematically illustrates a conventional mechanical voting machine modified in accordance with the present invention.

DETAILED DESCRIPTION OF THE DRAWINGS

Figure 2:
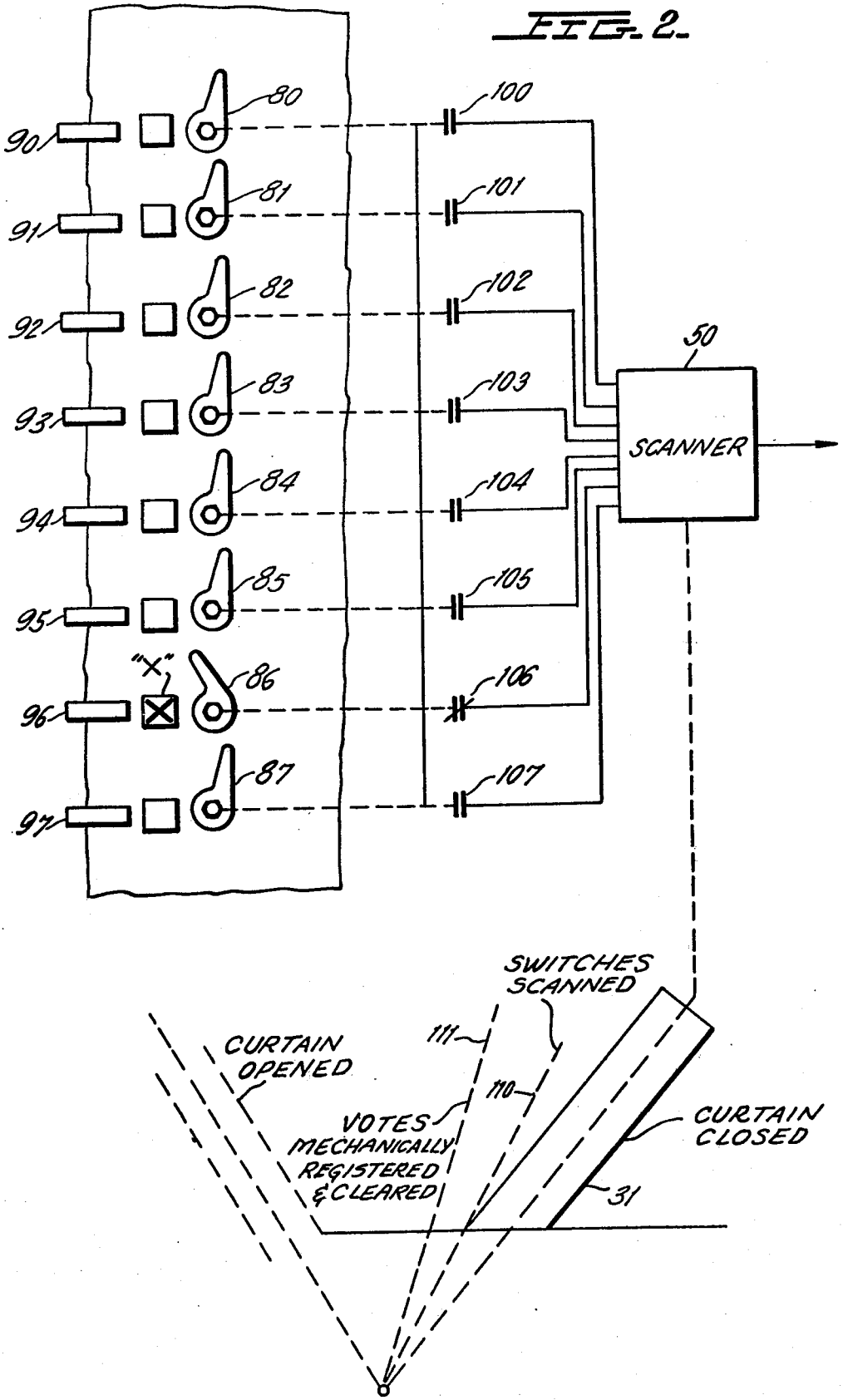
FIG. 2 is a schematic view of a portion of a conventional mechanical voting machine, modified in accordance with the invention, such that each voting lever operates a respective switch and an electronic scanner is operated by the curtain operating handle of the voting machine.

Referring first to FIG. 1, an automatic mechanical voting machine is schematically illustrated in block diagram form and contains a plurality of voter-operated levers, four of which are shown as levers 20, 21, 22 and 23. The voter-operated levers 20 through 23 can be conventional levers which are rotated by the voter with rotation of the lever revealing an X adjacent the lever to indicate that a vote has been cast for a given candidate or question.

Each of the voter-operated levers 20–23 are associated with respective counters 24–27, respectively, which indicate the number of times a vote has been recorded at the respective voter-operated lever in a given election. The count on the counters 24–27 is normally shielded from view while the voting machine is in operation. After the polls are closed, the voting machines are opened by appropriate officials and the counts on the individual counters are separately recorded and sent to a central tabulation region.

A conventional mechanical interlock system schematically illustrated by block 30 is also provided for the voting machine, and is coupled to the voter-operated levers 20–23 and their respective counters to provide various well-known interlock features. By way of example, the mechanical interlock 30 may prevent the actuation of more than one voter-operated lever for a particular office. This mechanical interlocking feature then prevents the invalidation of a vote due to the inadvertent casting of two votes for different candidates for the same office when only a single vote can be cast for that office.

The mechanical interlock 30 may also serve to allow a voter to change his vote before permanently recording the vote in the mechanical counter.

Further, the mechanical interlock 30 can serve to prevent an attempt to record the vote when, in fact, no voter-operated lever has been actuated.

A vote-recording member, shown by block 31, is next provided in FIG. 1 and is mechanically coupled to the mechanical interlock 30 and operates to return the individual voting lever spindles to a no-vote position and to cause the recording of the votes cast by the voter by his appropriate selection of various voter-operated levers after he is satisfied with his selections. Typically, the recording handle member 31 is the curtain opening handle provided on conventional mechanical voting machines which is actuated by the voter after he has completed his selections and is moved to a position which opens a security curtain. At the same time, the opening of the curtain causes the resetting of the individual voting levers. The mechanical counters 24–27, which are associated with the various voter-operated levers which were operated by the voter were advanced by one count and the added count remains when member 31 is operated.

In accordance with the present invention, a switch-type device is added to each voter-operated lever of the mechanical voting machine. Thus, FIG. 1 schematically illustrates switches 40–43 as being associated with voter-operated levers 20–23, respectively. The switches 40 to 43 may take any desired form and simply function to change state from a first state to a second state, where the change in state can be interrogated and recognized by an appropriate scanner when a vote recording operation takes place. The switch members 40–43 may typically consist of a pair of electrical contacts which are normally open, e.g. when their associated voter-operated lever has not been actuated, and is in a "no vote" position, and are closed when the voter-operated lever associated with the switch has been operated to a "vote" position. Note that the normally open and normally closed switch positions could be reversed, if desired.

It should be further noted that, while the description herein describes an electrical structure, any switching means could be used. For example, optical switching could also be employed, where the interruption or modulation of a beam of light could indicate that a respective voter-operated lever has been actuated. In addition to optical switching, any other type switching could also be employed, such as the switching of magnetic field or electric field, or the like. It should be further noted that the indication of the actuation of a voter-operated lever at the time the vote is recorded could be obtained directly from the mechanical counter as well as from the lever itself when the mechanical vote casting structure is actuated with the lever.

It should be further understood that the concept of the voter-actuated lever is intended broadly to cover those mechanical constructions which include rotatable levers or depressible buttons and the like, including solid state type switching structures which may exhibit no physical movement as a part of their actuation.

The output of each of the switches 40–43 and all other similar switches which would be installed in a conventional mechanical voting machine (in an actual voting machine there may be some 500 voter-operated levers so that 500 corresponding switching devices would be added to indicate the position of each at the time of vote recordation) are connected to a switch position scanner schematically illustrated in FIG. 1 as the switch position scanner 50. The switch position scanner 50 has the function of sequentially interrogating each of the switches 40–43 to determine their position at the time of vote recordation and to memorize these various switch positions so that the information can be later transmitted to appropriate electronic data processing equipment. Each of the mechanical voting machines used in a particular election may be coupled to similar switch position scanners for scanning the entire vote of the machine at the time a voter actuates the vote recording mechanism, or may be coupled into scanner 50 as illustrated by lines **50*a* and 50*b* in FIG. 1. FIG. 1 also schematically illustrates a second switch position scanner 51 which may be contained in a second mechanical voting machine which is at the same location as the mechanical voting machine described previously in connection with FIG. 1**.

The output of either or both the switch position scanners 50 and 51 as well as any other scanners which may be at the particular voting location are then appropriately connected to a telephone type transmitter 52 which is operative to transmit the switch position information stored in the scanners 50 and 51, and thus the votes recorded in the various machines at the location, to appropriate data processing locations. By way of example, the transmitter 52 transmits the information to a county computer 60 which may be located in the county in which the vote is being taken. Similarly, the data can also be transmitted to a state computer 61, a federal computer 62 and a news media computer 63. Obviously, any one or more of these computers could be used for a particular election and different official offices can receive the vote as required.

Each of the computers which are involved may contain a respective display or print-out structure, such as the displays 64–67, respectively, for computers 60–63.

Other telephone-transmitted information coming from other voting machine locations will also be received by the centrally located computers, these additional lines being indicated by input lines 70, 71 and 72 in FIG. 1.

The telephone-transmitter system 52, schematically illustrated in FIG. 1 for connecting the various switch position scanners to the electronic data processing equipment, may be embodied by presently available computer transmission equipment such as the system known as the Bell Data Phones. The switch position scanner 50 can be constructed using any desired well-known scanning techniques which allow the sequential scanning of the plurality of switches, such as switches 40–43 and the storage of the information at these switch positions for a short period of time. The storage time, for example, need be no longer than the time needed for a new voter to be installed in the voting booth.

The scanning operation must occur during an approximate one-quarter second interval that is taken for the recording of the vote on a conventional mechanical voting machine. Thus, the vote recording handle 31 is suitably connected to the switch position scanner 50 to cause it to interrogate the switch positions. The interrogation begins as soon as the handle 31 is actuated but before it is actually moved to the end position in which the voter operator lever positions are cleared to "no vote" positions and the associated switches 40–43 are reopened. The memory in scanner 50 should be sufficient to retain this information for at least approximately one to two minutes which is about the interval between actuation of the vote recording handle by a subsequent voter. Thus, the scanner 50 will have a one cycle memory for a 60 to 90 second period between recordings or retain information until close of polls. If desired, a single scanner 50 could operate to serve up to fifteen voting machines in a single precinct or, alternatively, each machine can be provided with its own switch position scanner 51.

In FIG. 1, the function of scanner 50 has been seen to periodically collect the data from each machine and will then clear the one cycle memory and transmit the data to the appropriate computer. Note that the computers 60–63 or some other municipal computer which receives transmitted information from the transmitter system 52 will serve the function of receiving the data, clearing the scanner memory, identifying the spindle pattern, and performing the necessary arithmetic functions such as an add zero or one while maintaining a running total of the vote for each office. A print-out of results then completes the basic system operation so that a running total can be displayed in the displays 64–67 with a complete tabulation being presented at almost the instant that polls are closed.

The information contained in the electronically processed display will always be subject to verification by reading this data against the total mechanical counter data when this data finally becomes available.

One of the important features of the present invention is that the novel switching structure can be added directly to existing mechanical voting machines now in the field. Advantageously, the switching elements may be constructed of mechanical switching devices formed on circuit boards and in groups of eight such that eight switches are carried on a given board with the board being directly connectable, for example, to the rotating spindles connected to the vote-casting levers. Obviously, any desired number of switches could be carried on a given board. The individual boards are then wired into conventional wiring harnesses, which are in turn connected to suitable terminals which allow convenient connection to the scanner device.

FIG. 2 schematically illustrates the front of a portion of an existing voting machine where the machine portion shown contains eight voter-operated levers 80 to 87. Levers 80 to 85 and 87 are in a "no vote" position so that the vote indicating square at their left shows a blank. Lever 86, however, has been rotated downwardly to a "vote" position so that an X appears in the vote indicating window to the left of lever 86. In addition, each of the levers 80–87 have counters associated therewith where the count is viewable through windows such as 90–97 which are immediately next to their respective levers 80–87. Note that the count on these counters is normally obscured from the view of the voter by internally positioned shields which are removed only when the polls are closed and the mechanical count is read off the individual counters by election officials.

In accordance with the invention, the shaft which rotatably mounts spindles 80–87 is operatively connected to individual switches 100–107 which are open when their respective voter-operated lever is in a no vote position and are closed when their associated voter-operated levers are moved to a vote position. Note, for example, that contact 106 is closed since lever 86 has been rotated to a vote position.

Each of the contacts 100–107 are then coupled to the scanning circuit 50 which was previously described in connection with FIG. 1. FIG. 2 further illustrates the use of the curtain handle 31 of FIG. 1 for causing the operation of the scanner 50. The curtain handle 31 is shown in the curtain-closed position in FIG. 2 and can be rotated to the left-hand dotted line position where the curtain is fully opened. In moving to this position, handle 31 moves through the dotted line "switches scanned position 110" and then to a "vote mechanically registered and cleared position" 111. Thus, during the act of moving the handle to the curtain-open position, the voter automatically causes the actuation of scanner 50 so that the position of the various switches 100–107 are scanned before they are reopened. That is to say, the movement of handle 31 causes all of the voter-operated levers to return to a no vote position and also causes the appropriate mechanical counters to retain an additional count.

If desired, further circuits can be provided such that once the handle is moved to the switches scanned position 110, the scanner is operated and cannot thereafter be operated until the handle has been moved fully to the curtain opened position. This would then prevent the possibility of a voter "teasing" the operating handle to cause the electronic recordation of the vote without causing its mechanical recordation since the handle is not moved far enough to cause opening of the curtain and mechanical recordation of the vote.

Figure 3:
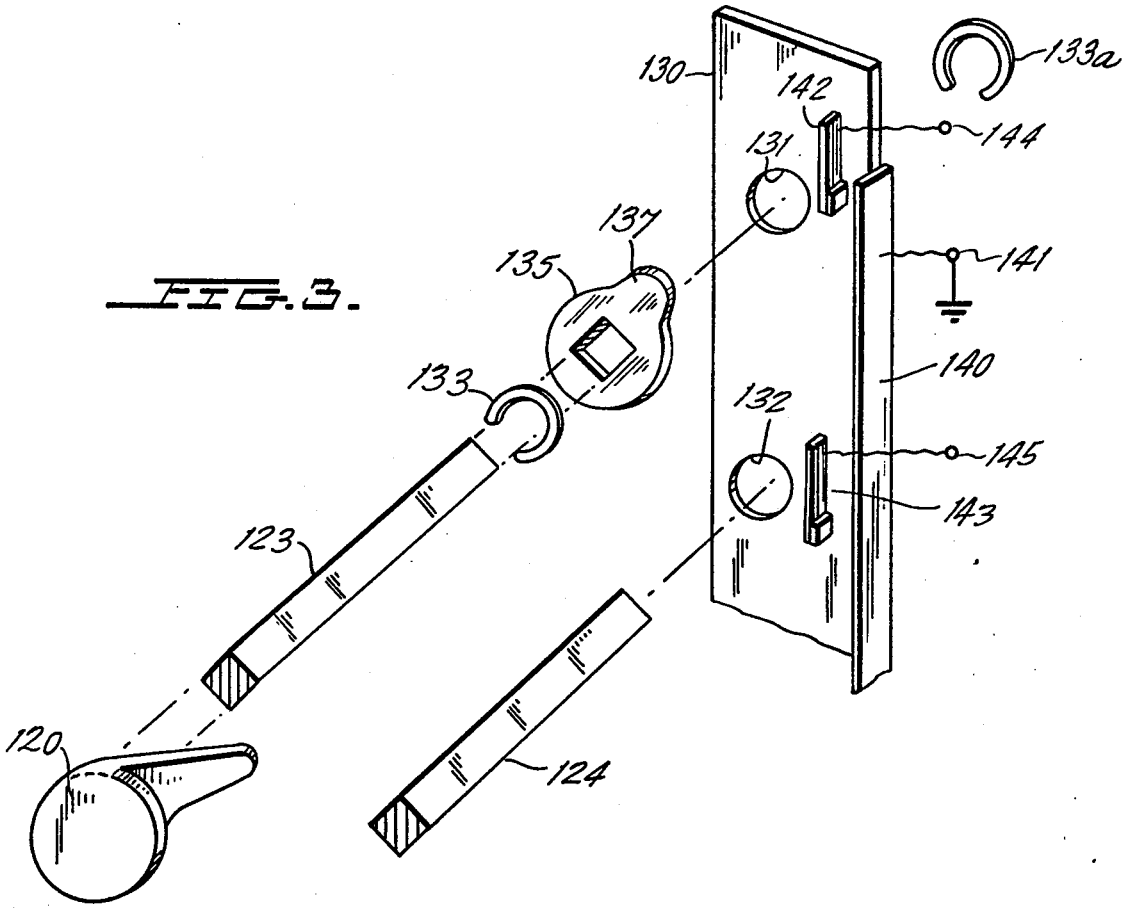
FIG. 3 is a exploded perspective view of one typical structure which could be employed to provide a switch structure on each spindle of a mechanical voting machine.
Figure 4:
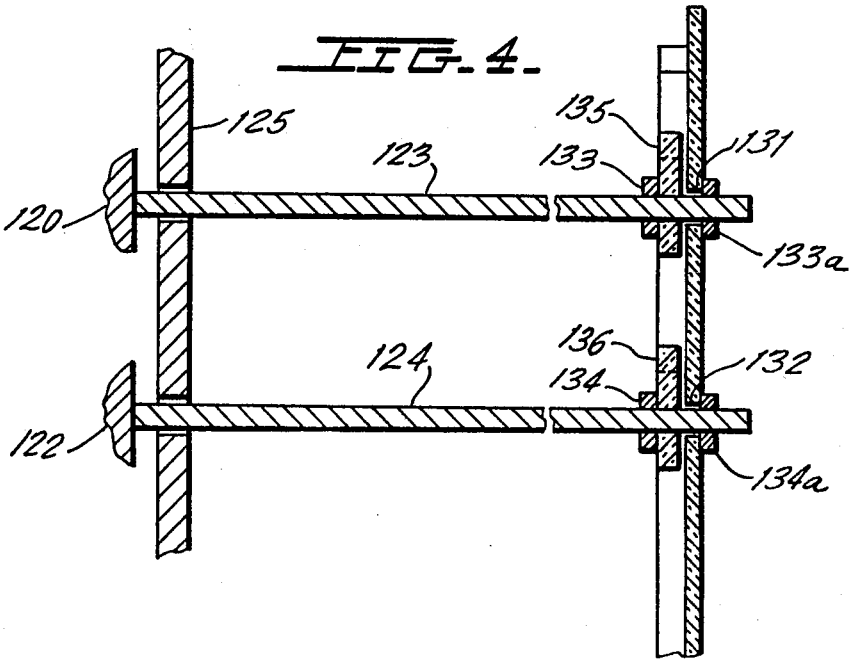
FIG. 4 is a cross-sectional view through the two spindles of FIG. 3.

FIGS. 3 and 4 illustrate one type of structure which can be used to add the switch structure to the conventional mechanical voting machine. Thus, in FIGS. 3 and 4 voter-operated levers 120 and 122 are schematically illustrated as connected to elongated rotatable spindles 123 and 124, respectively. Note that in FIG. 4 the spindles 123 and 124 extend through the front surface 125 of the voting machine and that the handles 120 and 122 are accessible by the voter externally of the front panel 125. A printed circuit board of insulation material 130 is then provided which has a plurality of openings including openings 131 and 132 therein which are spaced to receive the ends of spindles 123 and 124. In a typical embodiment, the printed circuit board 130 will be sufficiently long to accommodate eight or more aligned spindles.

Position locating clips 133 and 134, as well as other similar clips for the other of the eight spindles which receive board 130, are then placed on the spindles and are secured in position in any desired manner as by cementing or by mounting the clips within suitable notches formed in the square cross-section spindles 123 and 124. Switch operating insulation buttons 135 and 136 which have projections, such as projection 137 on button 135, are then mounted on spindles 123 and 124. The scanning projections, such as projection 137, may be aligned with one another by virtue of the square opening in the insulation member which cooperates with the square cross-section shape of the spindles 123 and 124. The insulation circuit board 130 is then placed over the aligned spindle as shown in FIG. 4 and against the surface of the rotatable insulation members 135 and 136 and is held in this position by suitable clips 133*a* and 134*a* as shown in FIG. 4.

The board 130 has a conductive strip 140 along its outer edge which protrudes slightly above the surface of plate 130 to serve as a stationary contact member. Contact strip 140 is connected to terminal 141 which can be connected to the scanner 50. Individual leaf spring type contact members are also provided on the strip and adjacent the strip 140 and include flexible contacts 142 and 143. Each of the contacts, such as contacts 142 and 143, are secured at their top to the board 130 and are flexibly movable into and out of engagement with the common stationary contact strip 140. Thus, when a particular voting lever, such as voting lever 120, is moved to a vote-indicating position, its respective insulation member 135 rotates clockwise and scan projection 137 engages the contact strip 142 to flex it into engagement with the stationary contact strip 140. When the vote lever 120 and spindle 123 are rotated counterclockwise to the no vote position, the spring material of strip 142 causes it to flex to its normal, out-of-contact position.

It will be apparent to those skilled in the art that any other desired type of switching arrangement can be provided in a simple and convenient manner since the spindles of the conventional mechanical voting machine are easily accessible at their ends, within the interior of the machine, so that simple circuit boards can be easily slid into place over the spindle, with switches being automatically connected to the individual spindle.

Although the present invention has been described in connection with a preferred embodiment thereon, many variations and modifications will now become apparent to those skilled in the art. It is preferred, therefore, that the present invention be limited, not by the specific disclosure herein, but only by the appended claims.

The embodiments of the invention in which an exclusive privilege or property is claimed are defined as follows:

1. A voting machine comprising, in combination:

a plurality of individual and manually operable vote casting members disposed in a given array and being manually operable between a no vote and a vote position;

a vote recording member operable from a vote enabling position to a vote recording position for recording the votes cast by a given voter by operating the said plurality of vote casting members;

a plurality of mechanical extension means connected to and extending from each of said plurality of vote casting members, respectively, and being mechanically operated between a first and a second position in response to the movement of their said respective vote casting member from said no vote and vote positions, respectively;

mechanical interlock means connected to at least selected ones of said plurality of vote casting members, whereby only a preselected number of said selected ones of said vote casting members can be placed in their said vote position at one time;

a printed circuit board means stationarily mounted with respect to said plurality of mechanical extension means and carrying circuit conductor means and a plurality of first circuit switching means thereon;

a plurality of second circuit switching means connected to said plurality of mechanical extension means, respectively; each of said plurality of second circuit switching means being operable by their said respective mechanical extension means between a first and a second switching position in response to movement of said each of said respective mechanical extension means between their said respective first and second positions; each of said plurality of second switching means being disposed for cooperation with a respective one of said plurality of first switching means;

each of said plurality of first and second switching means respectively defining a respective open circuit with said circuit conductor means when their respective one of said plurality of vote casting members is in one of its no vote or vote positions, and a closed circuit with said circuit conductor means when their said respective one of said plurality of vote casting members is in the other of its no vote or vote positions;

electronic scanning means connected to said circuit conductor means and operable to scan the condition of each of said plurality of first and second switching means when said vote recording member is operated to its said vote recording position;

and electronic data processing means connected to said scanning means for tabulating and displaying the total votes cast by each of said plurality of vote casting members.

2. The voting machine of claim 1 wherein said scanning means includes memory means for storing the condition of each of said first and second switching means after operation of said vote recording member to said vote recording position and wherein said scanning means further includes means for reading out said positions to said electronic data processing means at a selected time.

3. The voting machine of claim 1 wherein said electronic data processing means is remotely located relative to said plurality of vote casting members and wherein said scanning means is located with said plurality of vote casting members; and telephone line connection means for electrically connecting said scanning means to said electronic data processing means.

4. The voting machine of claim 1 wherein each of said plurality of vote casting members includes a rotatable lever, and wherein said plurality of mechanical extension means each includes respective elongated rotatable spindles.

5. The voting machine of claim 1 wherein said circuit board means consists of a flat, relatively thin member of electrical insulation material.

6. The voting machine of claim 1 which further includes respective visual indicator means connected to said plurality of vote casting members for visually indicating the position of each of said plurality of vote casting members in said no vote or vote position.

7. The voting machine of claim 1 which further includes interlock means connected between said vote recording member and said plurality of mechanical extension means for preventing the movement of said vote recording member to its said vote recording position when all of said plurality of vote casting members are in their said no vote position.

8. The voting machine of claim 4 wherein said first and second switching means are located adjacent to the respective spindles.

9. The voting machine of claim 6 which further includes interlock means connected between said vote recording member and said plurality of mechanical extension means for preventing the movement of said vote recording member to its said vote recording position when all of said plurality of vote casting members are in their said no vote position.

* * * * *